US006112443A

United States Patent [19]

Stubbs

[11] Patent Number: 6,112,443

[45] Date of Patent: Sep. 5, 2000

[54] EMERGENCY SIGNALLING APPARATUS AND METHOD

[76] Inventor: Arthur D. Stubbs, 1010 Vereda Callada, Escondido, Calif. 92029

[21] Appl. No.: 09/115,970

[22] Filed: Jul. 15, 1998

[51] Int. Cl.[7] ..... G09F 21/04; G09F 15/00

[52] U.S. Cl. ..... 40/591; 40/592; 40/593; 40/606; 116/173; 160/370.21

[58] Field of Search ..... 40/591, 592, 593, 40/606; 116/173; 160/370.21, 370.22, 370.23

[56] References Cited

U.S. PATENT DOCUMENTS

| | | | |
|---|---|---|---|
| D. 418,930 | 1/2000 | De Leon | D26/31 |
| 3,738,039 | 6/1973 | DeFuria | 40/591 |
| 3,762,360 | 10/1973 | Hawes | 40/591 X |
| 3,903,629 | 9/1975 | Gruna | 40/591 |
| 4,091,553 | 5/1978 | Glennie | 40/591 |
| 4,348,978 | 9/1982 | Brucato | 40/591 X |
| 4,375,134 | 3/1983 | Sheetz | 40/591 |
| 4,574,726 | 3/1986 | Sullivan | 40/592 X |
| 4,751,115 | 6/1988 | Smith et al. | 160/370.23 X |
| 4,884,524 | 12/1989 | Minotti | 116/173 X |
| 4,922,223 | 5/1990 | Prevot | 40/592 X |
| 4,986,209 | 1/1991 | Spica | 116/173 X |
| 5,156,274 | 10/1992 | Williams, Jr. et al. | 40/600 X |
| 5,226,792 | 7/1993 | Darago | 40/591 |
| 5,233,938 | 8/1993 | Lalo | 116/173 |
| 5,406,463 | 4/1995 | Schexnayder, Sr. | 40/542 X |
| 5,502,909 | 4/1996 | Rabkin | 40/603 |

*Primary Examiner*—Terry Lee Melius
*Assistant Examiner*—Rodrigo J. Morales
*Attorney, Agent, or Firm*—Higgs, Fletcher & Mack LLP; Bernard L. Kleinke

[57] ABSTRACT

A display device to discourage or encourage the summoning of an emergency response includes a display support positionable near an emergency site. The display device has a display area having indicia to discourage the summoning of an emergency response. Additionally, the display area may have indicia to encourage the summoning of an emergency response. In a method of using the display device, a display is placed proximate an emergency site, a first indicia is displayed to encourage the summoning of an emergency response, notice is received that help has been summoned, and the first indicia is replaced with a second indicia that indicates further summoning of the emergency response is not necessary.

9 Claims, 5 Drawing Sheets

EMERGENCY SIGNALLING APPARATUS AND METHOD

BACKGROUND OF THE INVENTION

The field of the present invention is emergency signaling and devices to accomplish the same.

The use of signage to indicate the condition of a stationary vehicle is well known in the art. For example, Rabkin, U.S. Pat. No. 5,502,909, discloses a sign to display distress signals for alerting passing motorists. On seeing the sign, it is hoped that a passing motorist will summon an appropriate emergency response. Indeed, Rabkin shows several versions of the distress displays such as a sign to request the police, a sign to request the fire department, a sign to request a tow truck, or a sign to request an ambulance. Thereby a passing motorist would know what type of assistance is needed and summon such assistance to the disabled stationary vehicle.

Also well known in the art are various methods to attach distress signage to a stationary vehicle. For example in Rabkin, discussed above, distress signage is secured to the vehicle or the vehicle's window using a suction cup. In Panossian, U.S. Pat. No. 5,249,381, distress signage is clipped to the top of a lowered side window with the signage extending perpendicularly from the window.

The prior art thus discloses structures and methods for a person to display signage proximate a disabled stationary vehicle that encourages a passing motorist to summon an emergency response.

However, when a person parks a vehicle on the shoulder of a road, that person does not always need emergency assistance. Unfortunately, the people in the passing cars who observe the stationary vehicle have no way of knowing that an emergency response is not desired. The observers in the passing cars may assume help is needed and stop to offer personal assistance or call the authorities for a professional emergency response. Such a needless emergency response unnecessarily could place the observer at risk if the observer is intent on robbing the person in the parked vehicle, or even causing bodily harm to him or her. Also, if an observer in good faith calls for assistance, the emergency response system is unnecessarily burdened if the observer calls for assistance when one is required or desired.

For example, if a vehicle has a flat tire, the driver may prefer changing the tire themselves without outside assistance. If a passing vehicle stops to offer assistance, there is a risk of accident or mishap as the vehicle offering assistance enters and exits the lanes of active traffic.

Further, today it is common for drivers to have portable or cellular telephones. Drivers may thereby easily summon emergency help by calling an emergency number such as 911 or the Highway Patrol and indicate the location of an emergency site. For example, drivers may see a vehicle parked on the shoulder of a road, assume assistance is needed, and summon help to that site. In other circumstances, a driver may not have access to a portable telephone. However, call boxes are now installed on many freeways whereby a driver may stop and immediately contact an emergency organization such as the Highway Patrol. In such a situation the driver may see a stalled vehicle, assume help is needed, and drive ahead to a call box and contact authorities.

However, the person at the stationary vehicle may not want or even need a professional emergency response to be summoned to the stationary vehicle. It is highly desirable to avoid unnecessary calls to an emergency response system, and thereby clog its communication system. Thus, it would be highly desirable to avoid any unnecessary burden on the emergency response system.

In another example, a vehicle becomes disabled and the driver desires assistance. Using prior art signage the driver may indicate that assistance is needed and therefore passing motorists may summon a professional emergency response. It is even likely on a busy road that several drivers will make calls to summon an emergency response. Further, in some circumstances, a passing motorist may, in good faith, stop and offer personal assistance. Indeed, the driver with the disabled vehicle may become aware that an emergency response has already been requested or find that an emergency response is no longer needed. However, those vehicles passing by will not know that an emergency response has already been requested and may therefore continue to call 911 or other emergency number for requesting an emergency response. Others may also stop to offer assistance themselves, and the stranded motorist may be placed in jeopardy, if the person who is ostensibly stopping to help has evil motives. In such a case, the stranded motorist maybe placed in fear of bodily harm. Also, the motorist who is stopping to help, has increased the chance of accident or mishap by entering and exiting the active travel lanes. Moreover, the emergency response system may become unnecessarily burdened.

Thus, it would be highly desirable to have a new and improved device and method which would not place the stranded motorist in jeopardy, and would not cause the emergency response communication system to become clogged with unnecessary calls. Additionally, such a device and method should not cause disruption to the normal flow of traffic.

SUMMARY OF THE INVENTION

It is therefore a principal object of the present invention to provide a new and improved device and method which can be used to assist a stranded motorist, without placing the motorist in jeopardy, and without causing unnecessary and unwanted clogging of the emergency response communication system.

Briefly, the above and further objects of the present invention are realized by providing a kit for allowing a person to encourage or discourage observers from summoning an emergency response.

The present invention includes a device and method wherein an indicia is positionable on a display area of a display support with the display support placed proximate an emergency site such that the display area may be seen by an observer of the emergency site. The indicia communicates a message to the observer to discourage the observer from summoning an emergency response. Further, a second indicia may be positionable on the display wherein the second indicia communicates a message to encourage the observer to summon an emergency response. A kit is also provided to notify others of the status of an emergency response. The kit comprises a display support, a first display attachable to the display support with indicia for encouraging the summoning of an emergency response, and second display attachable to the display support and having indicia for discouraging the summoning of an emergency response.

BRIEF DESCRIPTION OF DRAWINGS

The above mentioned and other objects and features of this invention and the manner of attaining them will become apparent, and the invention itself will be best understood by reference to the following description of the embodiment of the invention in conjunction with the accompanying drawings, wherein.

DESCRIPTION OF THE PREFERRED EMBODIMENT

Figure 1:
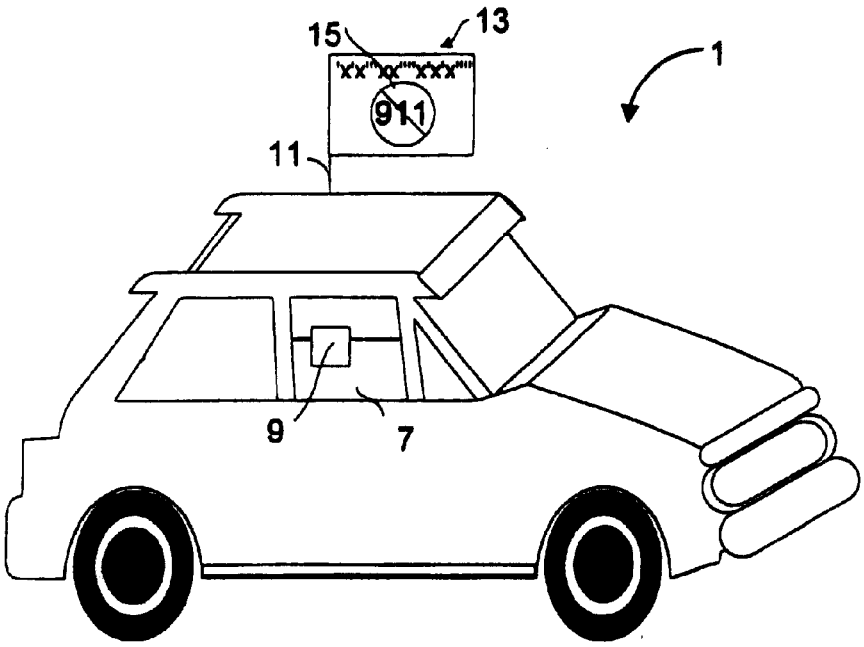
FIG. 1 is a pictoral perspective representation of a stationary car having flag signage constructed in accordance with the present invention.

Referring to FIG. 1, a flag 13 constructed in accordance with the present invention is depicted on a stationary vehicle 1. The stationary vehicle 1 is stopped by the side of a road while other vehicles continue to pass by in either direction. The driver and any passengers in the passing cars may be observers of the stationary vehicle 1. The indicia 15 on the flag 13 communicates a message to these observers that the observers should not summon an emergency response to the stationary vehicle. Although not shown in FIG. 1, another flag having indicia to encourage the summoning of an emergency response may alternatively be displayed.

Figure 8:
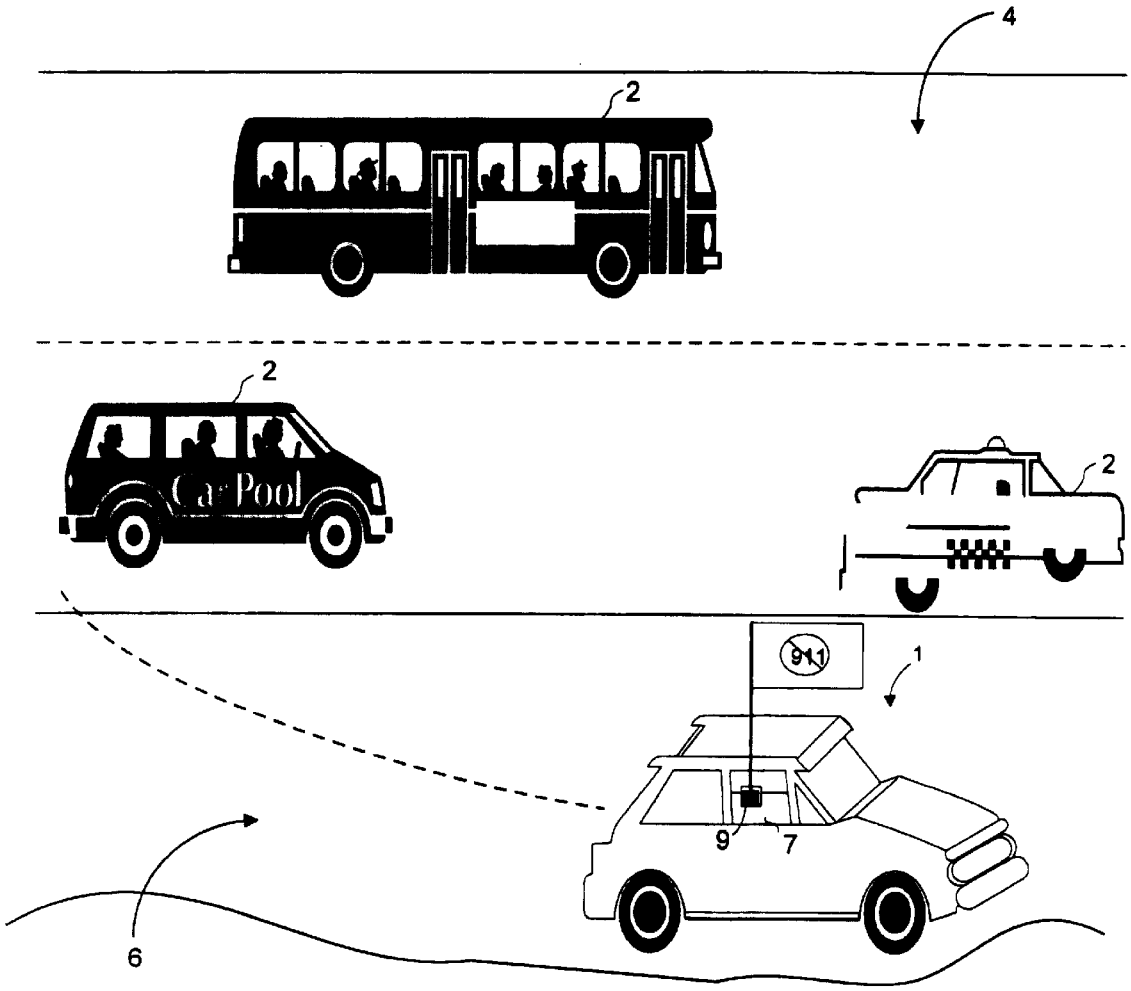
FIG. 8 is a pictoral representation showing the stationary vehicle of FIG. 1 positioned adjacent to a road.

To better understand the advantages of using the flag 13, FIG. 8 depicts a road 4 having a shoulder 6 with moving cars 2. One of the moving cars 2 had an emergency situation and pulled to the shoulder 6 and is now the stationary vehicle 1 shown in FIG. 1. Although the people in the moving cars 2 do not know why the stationary car 1 is parked on the shoulder, they may consider the stationary vehicle an emergency site and stop to offer assistance or contact authorities. However the people in stationary car 1 may want to discourage the people in the moving cars 2 from either stopping or contacting authorities. To discourage an emergency response, the people in the stationary car mount flag 13 on the car 1. The flag 13 is viewable by passing motorists so that the indicia 15 communicates to any observer that no emergency response is desired.

FIG. 1 shows a support bracket 9 attached to a side window 7 of the car 1. The support bracket 9 may simply clip to the window or may have a clamping mechanism. Those in the art will readily recognize that several alternatives exist to attach the support bracket 9 to the side window 7. A pole 11 is attached to the support bracket 9 and extends up and away from the vehicle. A flag 13 is attached to the pole such that the flag 13 extends substantially perpendicular to the pole and is rotatable such that the indicia 15 may be read by those observing the emergency site.

The flag 13 has indicia 15 to indicate that an emergency response is not desired. The indicia 15 has the numbers 9-1-1 within a circle-and-slash symbol. Nine-one-one is commonly known throughout the United States as a phone method to summon emergency assistance. The circle and slash symbol is internationally known to mean "no." Therefore the indicia 15 shown in FIG. 1 symbolically displays to observers they are not to call for help, thus discouraging the observers from initiating an emergency response. Additionally, the flag 13 may have further indicia 15 indicating that the police are en route or other such message to further communicate that summoning an emergency response is not desired. Those skilled in the art will readily recognize that several alternatives exist for indicia 15 that will successfully discourage the summoning of an emergency response. The flag 13 is most conveniently provided as part of a kit.

Figure 7:
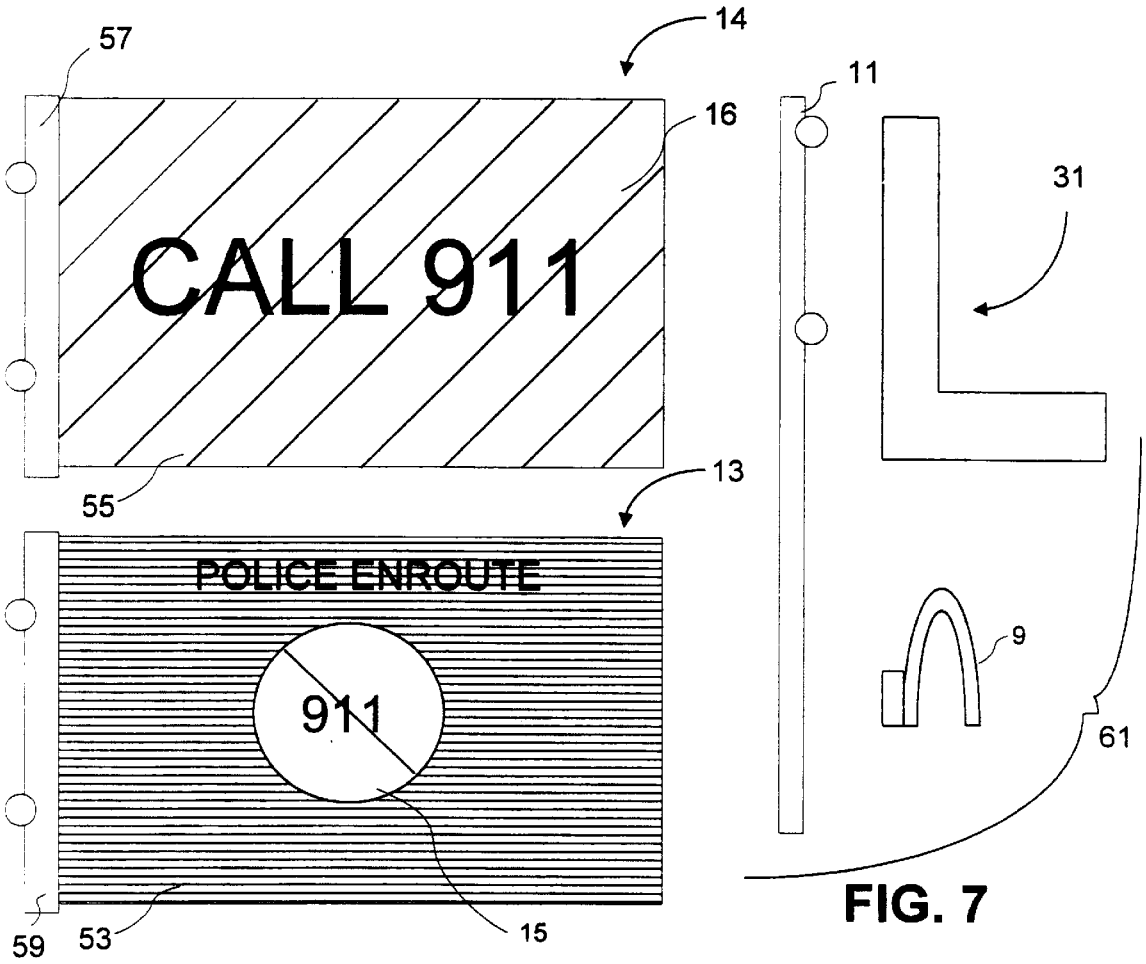
FIG. 7 is a diagrammatic representation of a kit constructed in accordance with the present invention.

FIG. 7 shows the flag 13 as a component of kit 61. Kit 61 is designed to be conveniently carried in a vehicle. The kit 61 contains two flags with the first flag 13 having indicia 15 to discourage the summoning of an emergency response and a second flag 14 having indicia 16 to encourage the summoning of an emergency response. The indicia 16 communicates to an observer that the observer should call 9-1-1. Nine-one-one is commonly understood as the emergency call number. Therefore, an observer would know to contact authority or stop to offer assistance. Those skilled in the art will recognize that other indicia readily exists that will communicate a similar message to observer.

The kit 61 further contains a pole 11 wherein the pole 11 may be telescoping or made in sections such that the pole 11 conveniently collapses, folds, or disassembles for easy storage. The kit 61 also contains a window bracket 9 wherein the window bracket 9 conveniently attaches to a side window and is adapted to hold and support the pole 11. The flags 13 or 14 are then positionable on the pole 11 so that the indicia 15 or 16 are visible to the moving cars 2.

Flags 13 and 14 are constructed from a sheet material 53 and 55, respectively. The sheet material is preferably cloth, but can be plastic, paper, cardboard or other sheetable material. The indicia is printed on the sheet material, although those skilled in the art will recognize that the indicia may be applied to the sheet material by other processes such as plastic transfer or paint. One edge of the flags 13 and 14 have sleeves 59 and 57, respectively, for receiving the top end of the pole 11. Sleeves 59 and 57 may be constructed from the sheet material or be of another material and bonded to the sheet material.

In use, the flag 13 may initially be mounted on pole 11 to completely discourage the summoning of an emergency response. Alternatively, the flag 14 may initially be mounted on pole 11 to encourage the summoning of an emergency response and then replaced with flag 13 when the continued summoning of the emergency response is no longer desired. Kit 61 also has a container (not shown) for conveniently holding the flags 13, 14, the pole 11, and the window bracket 9. The container may also contain additional emergency items such as flares, flashlights, radios, batteries, food supplies, thermo blankets or other such emergency items. Those skilled in the art will recognize that several alternatives for the container exist, such as a tube or bag.

In using the kit 61 shown in FIG. 7, a person in the stationary vehicle 1 positions the window bracket on a side window in a position that will maximize the visibility to passing cars 2. The pole is extended and secured into the support bracket. Those skilled in the art will readily recognize that several alternatives for the pole exist. If the person with the stationary vehicle 1 desires an emergency response, the flag 14 is placed on the pole 11 in a position visible to passing cars 2. Flag 14 has indicia 16 to communicate a message that assistance is needed. In such a manner, those people in the passing cars 2 understand they should use their portable phones or other means to contact authorities to initiate an emergency response. Further, such a display may encourage a moving car to pull out of the moving traffic lanes, onto the shoulder, and personally assist at the stationary vehicle. The person stopping to assist may have a portable phone and contact the authorities right from the emergency site. In such a case, the person with the stationary vehicle 1 now knows that an emergency response has been initiated. Once having received notification the emergency response has been initiated, the flag 14 may be replaced with flag 13, thus displaying indicia 15 to discourage further summoning of an emergency response.

Figure 5A:
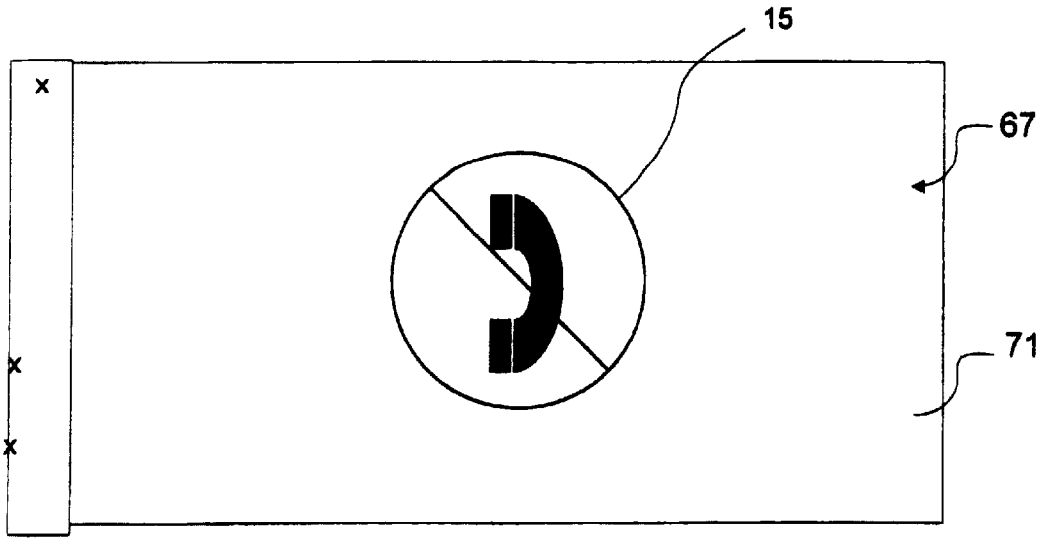
FIGS. 5A and 5B are diagrammatic front views of flags constructed in accordance with the present invention having indicia to discourage the summoning of an emergency response; color is indicated by appropriate pattern.
Figure 5B:
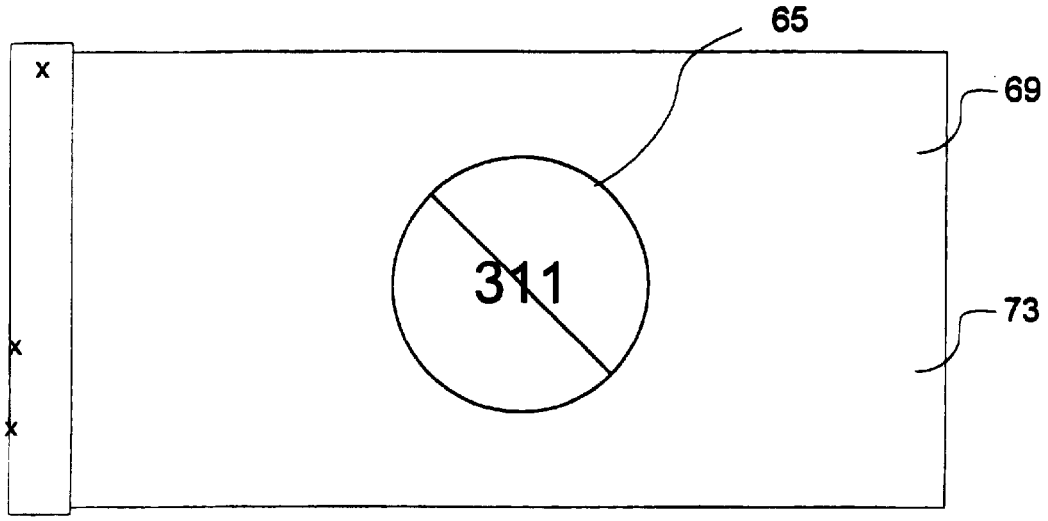

FIGS. 5A and 5B show preferred variations for flags to discourage an observer from offering assistance or contacting authorities to initiate an emergency response. FIG. 5A has a flag 67 constructed similar to flag 13. Flag 67 has indicia placed on sheet material 71. The indicia 63 is a symbol of a telephone receiver within a large circle with a diagonal line. Such a symbol would be readily understood to mean "do not call authorities." Thus, a person seeing this indicia 63 would understand that it is not necessary or desired to summon an emergency response or stop and offer assistance.

In several metropolitan areas the 911 system is severely overloaded. To reduce the burden on the 911 system, some areas now have a 311 system. The 311 system is designed for people to contact authorities for non-life threatening situations. FIG. 5B shows another alternative flag 69 also constituted in accordance with the present invention. Flag 69 has indicia 69 on sheet material 73. The indicia 65 is the number 311 within a large circle with a diagonal line. Such a symbol would be readily be understood to mean "do not call authorities." Thus, alone, or in combination with other indicia , people in the moving cars 2 would be discouraged from calling for an emergency response.

The flags preferably use color to assist in assuring the proper message is received by the observer in passing cars 2. For example, flags having indicia to encourage the summoning of an emergency response may be in orange, a color widely associated with an emergency situation. Thereby flag 14 would preferably have an orange color over most or all of its surface. Flags having indicia to discourage the summoning of an emergency response will be in a more neutral color, such as blue. Thereby flags 13, 67 and 69 would preferably have a blue background. FIGS. 5A, 5B, 6 and 7 therefore indicate color, although those skilled in the art will recognize other colors will successfully facilitate communicating the desired message to the passing cars 2.

Figure 2:
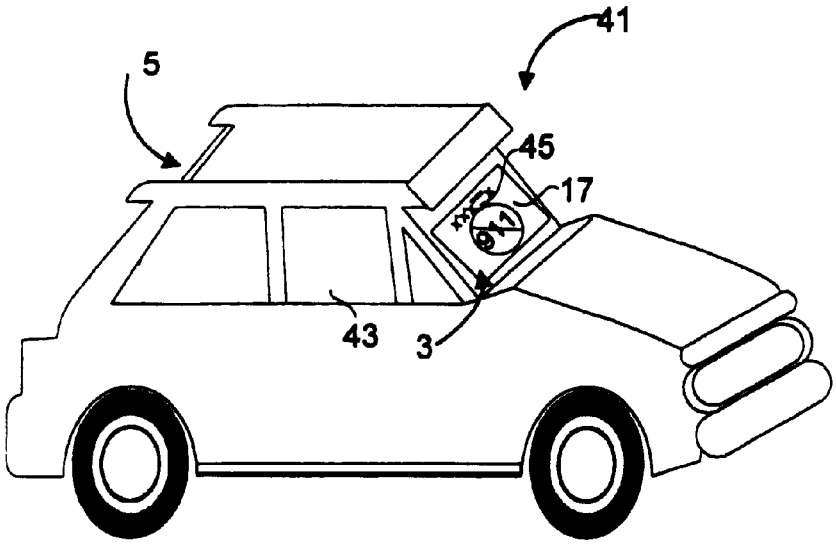
FIG. 2 is a pictoral perspective representation of a stationary car having window plaque signage constructed in accordance with the present invention.

FIG. 2 shows a window placard 17 also constructed in accordance with the present invention. The window placard 17 has indicia 45 positioned such that the indicia 45 is visible to observer in passing cars when the window placard 17 is placed in either the front or back window, or both. Alternatively, window placards 67 may be positioned on side windows if the side windows are more visible to passing motorists. Those skilled in the art will recognize that window placards may take several alternative configurations. For example, the window placard 17 may be the well-known windshield sunlight visor that is positionable in either the front or rear window. Alternatively, the placard 17 could attach to any window with suction cups or another attachment means. Although several options for the window placard exist, it is important that the window placard 17 is placed inside the vehicle such that the indicia 45 is visible to the observer in the moving cars 2.

It is also desirable that the window placard 17 have indicia 45 on one side for discouraging the summoning of an emergency response and indicia on the other side encouraging the summoning of an emergency response. In this manner one or more plaques may be displayed encouraging the summoning of an emergency response and when the continued summoning is no longer desired, the placards may simply be inverted to present the indicia 45 to discourage continuing summoning of emergency response.

Figure 6:
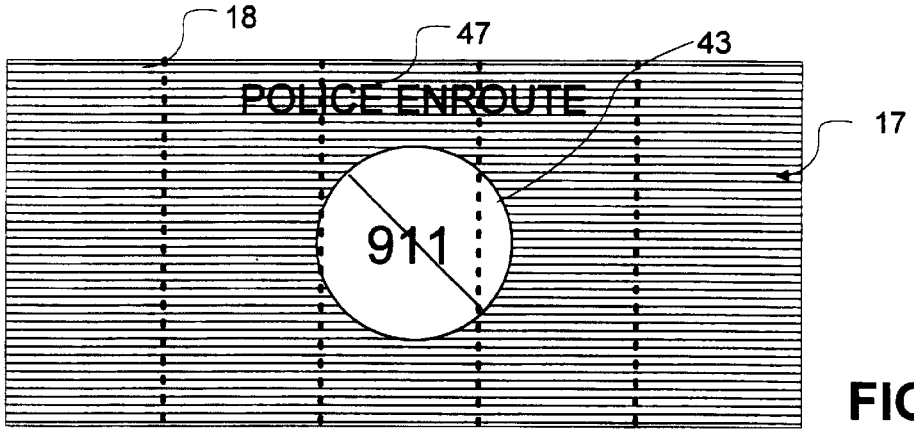
FIG. 6 is a diagrammatic front view of a window visor constructed in accordance with the present invention having indicia to discourage the summoning of an emergency response; color is indicated by appropriate pattern.

FIG. 6 shows the window placard of FIG. 2 is a windshield sun-visor for placement in the front or rear window. Although several versions of the sun-visor exist, the one shown is made of cardboard and folded for storage along fold lines 18. The window placard 17 not only has indicia 45, but also has indicia 47 to further communicate to observers that no assistance is needed. Indicia 47 communicates the police are en route, so any observer need not take any action to assist. The window placard 17 may use color to assist in communicating the proper message. Therefore window placard 17 is shown in blue, further communicating that no emergency situation exists.

Figure 3:
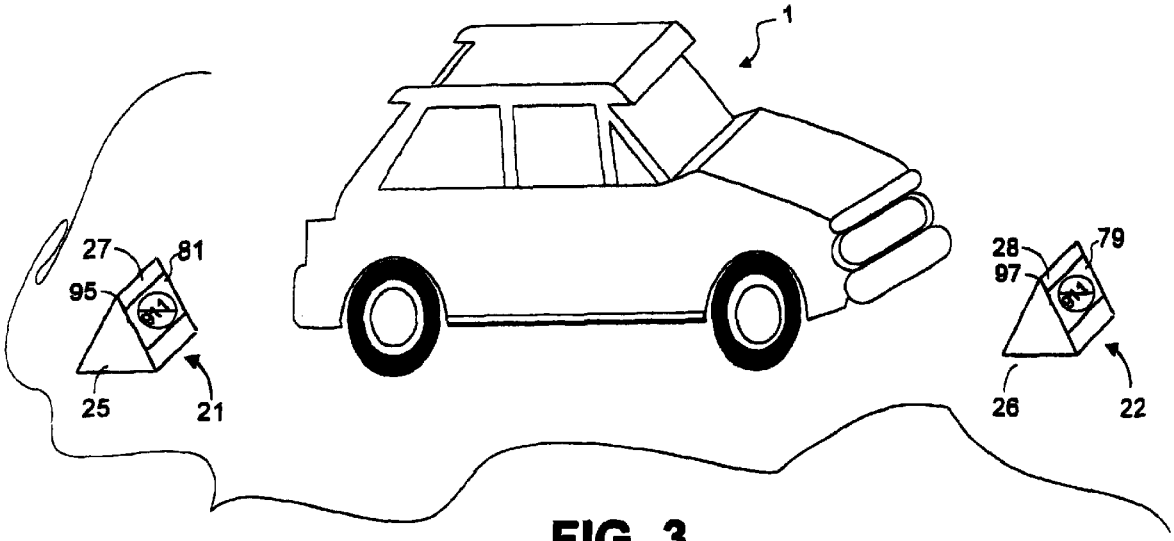
FIG. 3 is a pictoral perspective representation of a stationary car having L.E.D. road stand signage constructed in accordance with the present invention.

FIG. 3 shows a road stand 21 also constructed in accordance with the present invention. The road stand 21 is positioned outside the vehicle adjacent to the emergency site. The road stand 21 has a display stand 25 and a display area 27. The use of stands containing displays is well-known in the art and those skilled in the art will recognize that several alternatives exists to the exact configuration of the display stand 25 and display area 27.

Figure 4:
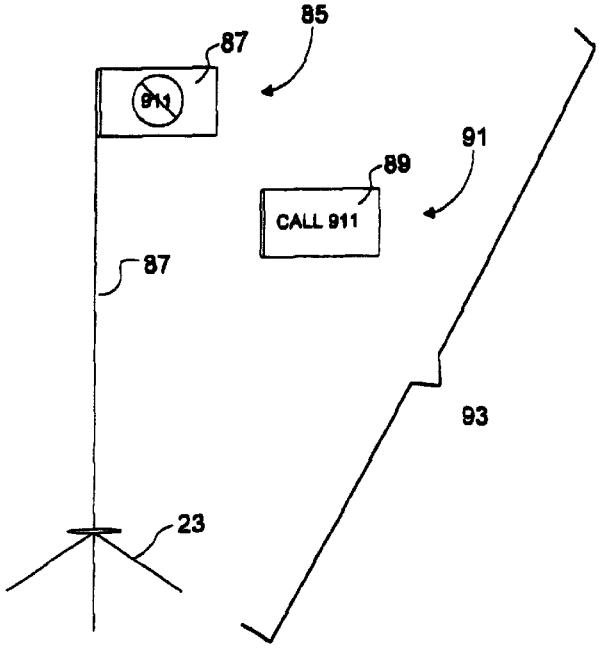
FIG. 4 is a pictoral perspective representation of another road stand constructed in accordance with the present invention.

The road stands 21 may be positioned either in front, in back, or along the side of the stationary vehicle 1 depending upon the proximity of the moving cars 2. The indicia 81 is shown on the display area 27 and directed toward the moving cars 2 wherein the people in moving cars 2 may readily see the indicia 81. The indicia 81 of FIG. 4 is preferably shown by an L.E.D. (Light Emitting Diode) display board 95.

The L.E.D. display board 95 may be powered by a battery stored in the display stand 25 or may be powered from the stationing car 1. If powered by a car, a cable (not shown) would extend from the road sign 21 to the car 1, with the cable connecting to the car's battery terminals or alternatively, the cable may plug into an available cigarette lighter socket.

L.E.D. display board preferably has the ability to display at least two indicia. The first indicia would encourage an emergency response and is similar to indicia 16, except the indicia is compound of illuminated L.E.D.'s; the second indicia 81 is similar to indicia 15 and would discourage any emergency response. A switch (not shown) on the road stand 21 allows the L.E.D. display board 95 to be in an off state, display indicia 81 to discourage an emergency response or display indicia to encourage an emergency response. The L.E.D. display board may be constructed to illuminate the indicia area only, while the rest of the board 81 remains unilluminated. Or, alternatively, the L.E.D. board may be generally illuminated in a color, such as blue or orange, with the indicia illuminated in a sharply contrasting color. As with the other means of community, the colors may assist in delivering the message to the observer.

FIG. 3 shows road stand 21 positioned behind car 1 and like road stand 22 positioned in front of car 1 thereby increasing visibility to passing cars 2. Road stand 22 has a display stand 26 with display over 28. L.E.D. board 97 is on the display area 28 and is showing indicia 79 to during an emergency response.

FIG. 4 shows kit 93 which comprises a road stand constructed in accordance with the present invention. Here a pole 87 rests on a pole stand 23. A flag 85 is attached to the pole 87. The flag 85 is similar to flag 13 and has indicia 83 positioned such that the indicia 83 is visible to the moving cars 2. The indicia 83 communicates to the observers in cars 2 that no emergency assistance is needed. Alternatively, a flag 91, which is similar to flag 14, has indicia 89 to encourage the summoning of an emergency response. Flag 91 may be placed on the pole stand 87 for communicating a message to observers that an emergency response is desired Although the road stand of FIG. 4 has a flag, the road stand alternatively could display a placard (not shown) to passing cars. Preferably, the placard may have indicia placed on both sides of the placard. In such a case, the road stand may be configured to display indicia to summon an emergency response and when continued response is no longer desired, the placard may be removed, rotated and replaced on the road stand to display the indicia to discourage the further summoning of an emergency response. Additionally, the indicia may be constructed of a reflective material to increase the visibility to observers in passing cars 2.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. An emergency signaling method to encourage observers of an emergency site to summon an emergency response to the site to assist a stranded motorist requiring assistance, comprising the steps:

positioning means for displaying information proximate the emergency site so that the observers see said means for displaying information;

displaying first means for communicating information on said means for displaying information to communicate a message to the observers encouraging the observers to summon the emergency response to the site;

receiving notification that the emergency response has been successfully summoned;

removing responsive to the receiving notification said first means for communicating information from said means for displaying information;

displaying a second means for communicating information in response to the removing of said first means from said means for displaying; and communicating a message to discourage the observers from repeatedly summoning the emergency response after receiving successful summoning notification and to discourage the observers from stopping and placing the vehicle operator in jeopardy, said second means for communicating information discouraging the observers from offering assistance or summoning a further emergency response.

2. The emergency signaling method of claim 1 where the means for displaying information is a pole and the first means for communicating information is disposed on a first flag and the second means for communicating information is disposed on a second flag.

3. The emergency signaling method of claim 2 where the second means for communicating information is selected from the group: a symbol indicating that 911 should not be called, a symbol indicating that 311 should not be called, a symbol indicating the telephone should not be used, and a text message that police are en route.

4. The emergency signaling method of claim 1 where the means for displaying information is a window placard having a front side and a back side, wherein the first means for communicating information is disposed on the front side and the second means for communicating information is disposed on the back side.

5. The emergency signaling method of claim 1 where the display means is a light emitting diode board.

6. The emergency signaling method of claim 1 further including omitting the step of displaying first means, and summoning the emergency response by the stranded motorist, who thereafter displays said second means for communicating information.

7. An emergency signaling method to encourage observers of an emergency site to summon an emergency response to the site to assist a stranded motorist requiring assistance, comprising the steps:

determining that observers should summon the emergency response;

selecting a first flag indicating that an emergency response should be summoned, the first flag having indicia providing a message that an emergency response is desired;

positioning the first flag on a pole positioned proximate to the emergency site so that the observers see the first flag;

receiving notification that the emergency response has been successfully summoned;

removing, responsive to the receiving notification, said first flag;

selecting a second flag responsive to receiving the notification that the emergency response had been summoned, the second flag having indicia providing a message that an emergency response has already been summoned and discouraging observers from calling for an emergency response;

positioning the selected second flag on the pole positioned proximate the emergency site so that the observers see the selected second flag; and communicating a message to discourage the observers from repeatedly summoning the emergency response after receiving successful summoning notification and to discourage the observers from stopping and placing the stranded motorist in jeopardy.

8. The emergency signaling method of claim 7 where only the first flag is selected and positioned.

9. The emergency signaling method of claim 7 where the second flag is selected and displayed and later, the second flag is removed and the first flag is selected and displayed.

* * * * *